United States Patent [19]

Atkinson et al.

[11] Patent Number: 4,900,466

[45] Date of Patent: Feb. 13, 1990

[54] PROCESS FOR PREPARING NEEDLE-SHAPED CRYSTAL GROWTH MODIFIED BURKEITE DETERGENT ADDITIVE

[75] Inventors: Colin Atkinson, Barnston; Michael J. Heybourne, Potters Bar; William J. Iley, Bebington; Peter C. Knight, Neston; Peter J. Russell, Eastham; Thomas Taylor, Northwich; David P. Jones, Chester, all of England

[73] Assignee: Lever Brothers Company, New York, N.Y.

[21] Appl. No.: 248,341

[22] Filed: Sep. 20, 1988

Related U.S. Application Data

[63] Continuation of Ser. No. 921,666, Oct. 21, 1986, abandoned.

[30] Foreign Application Priority Data

Nov. 1, 1985 [GB] United Kingdom ..... 8526996
May 22, 1986 [GB] United Kingdom ..... 8612459

[51] Int. Cl.[4] ..... C11D 3/10; C11D 7/12; C11D 3/37

[52] U.S. Cl. ..... 252/174.14; 252/174.19; 252/174.24

[58] Field of Search ..... 252/135, 174.19, 174.24, 252/546, 558, 174.14

[56] References Cited

U.S. PATENT DOCUMENTS 4,303,556 12/1981 Llenado ..... 252/527
4,510,066 4/1985 Saar ..... 252/540
4,617,139 10/1986 Robb et al. ..... 252/135
4,707,290 11/1987 Seiter et al. ..... 252/140
4,818,424 4/1989 Evans et al. ..... 252/91
4,820,441 4/1989 Evans et al. .

FOREIGN PATENT DOCUMENTS 63399 10/1982 European Pat. Off. .
80222 6/1983 European Pat. Off. .
108429 5/1984 European Pat. Off. .
110588 6/1984 European Pat. Off. .
110592 6/1984 European Pat. Off. .
1265551 11/1984 European Pat. Off. .
130640 1/1985 European Pat. Off. .
221777 5/1987 European Pat. Off. .
981540 1/1965 United Kingdom .
1377591 12/1974 United Kingdom .
1398263 6/1975 United Kingdom .
2060675 5/1981 United Kingdom .
1595769 8/1981 United Kingdom .
1595770 8/1981 United Kingdom .
2097419 11/1982 United Kingdom .
2109398 6/1983 United Kingdom .

*Primary Examiner*—Prince E. Willis
*Attorney, Agent, or Firm*—Milton L. Honig

[57] ABSTRACT

Powders prepared by drying a slurry and suitable for use as detergent powders or components thereof contain (or consist of) sodium carbonate and/or the sodium carbonate/sodium sulphate double salt Burkeite the crystal forms of which have been modified by means of a low level of an organic polycarboxylate. The powders are able to absorb and retain very high levels of liquid components such as nonionic surfactants.

15 Claims, No Drawings

PROCESS FOR PREPARING NEEDLE-SHAPED CRYSTAL GROWTH MODIFIED BURKEITE DETERGENT ADDITIVE

This is a continuation application of Ser. No. 921,666, filed Oct. 21, 1986 now abandoned.

TECHNICAL FIELD OF INVENTION

The present invention relates to a novel particulate material prepared by drying a slurry and useful for carrying liquid components in a detergent composition; a process for producing it; and detergent compositions containing it.

BACKGROUND AND INTRODUCTION

The spray-dried detergent powders currently sold in most European countries contain relatively large quantities of sodium tripolyphosphate which acts simultaneously as a highly efficient detergency builder and as a structurant or matrix material for carrying the organic components, notably anionic and nonionic sufactants, present in the powder. Sodium tripolyphosphate hexahydrate, under the right conditions, crystallises during detergent slurry processing as a mass of small needle-shaped crystals which on spray-drying become interspersed with small pores predominantly less than 10 μm: such a pore size distribution is ideally suited to carrying mobile organic detergent components.

In recent years, it has been recognised that high levels of environmental phosphate cause eutrophication of inland waters and that phosphate-containing detergents may contribute to this. As a result various low phosphate or zero-phosphate detergency builder systems have been developed to replace sodium tripolyphosphate. One material that is cheap, readily available and has the requisite water-softening properties is sodium carbonate, and this is widely used in countries, for example, certain states of the USA, which impose a total ban on phosphates in detergents.

As a structurant or matrix material the sodium carbonate available as commerical grades of soda ash is far from satisfactory. These commerical anhydrous materials, when slurried in water at typical detergent slurry-making temperatures, crystallise as sodium carbonate monohydrate in the form of large crystals up to 100–200 μm in size. As a result, the particles formed by spray-drying are interspersed with large pores of the order of 100 μm in diameter. While the porosity within such particles may be adequate to absorb mobile organic components, the pores are in fact so large that such components will tend to "bleed". This will cause carton staining when the powder is stored in a cardboard carton, because the carton walls contain smaller pores than those holding the mobile components in the carbonate base, so that transfer of such components from the base to the carton is able to occur owing to capillary action.

SodiUm sulphate is also a well-known component of detergent compositions. When a slurry containing sodium carbonate and sodium sulphate is prepared, the anhydrous double salt burkeite ($2Na_2SO_4.Na_2CO_3$) can be formed to the extent that the proportions of the two salts present allow. This material, unlike sodium carbonate monohydrate, forms small crystals (about 10 μm), but they are packed together in dense aggregates. The presence of Burkeite has generally been regarded as a problem, largely because of the very low porosity resulting from the dense packing.

It has now been discovered that both sodium carbonate monohydrate and Burkeite can be converted to a more desirable crystal form in the slurry by the addition of a low level of a polycarboxylate material at a particular stage in the slurry-making process. The resulting modified crystal morphology is beneficial to the uptake and retention of mobile organic components.

It is essential that the polycarboxylate crystal growth modifier be present in the slurry before crystallisation of the relevant species occurs, that is to say, it must be incorporated not later than the revelant salts. This principle can be utilised to form a simple inorganic spray-dried base, a whole detergent powder, or any intermediate product.

Crystal-growth-modified spray-dried sodium carbonate monohydrate and Burkeite in accordance with the invention contain small crystals similar to those of sodium tripolyphosphate hexahydrate, and can be shown by mercury porosimetry to be interspersed to a large extent with very small ($<3.5$ μm) pores. These powders are capable of absorbing and retaining substantial quantities of liquid nonionic surfactants and other organic detergent components as a direct result both of a decrease in crystal size and of a less dense form of crystal packing, giving particles of greater porosity than those produced in the absence of a crystal growth modifier. The modified crystal structure can be recognised by optical or electron microscopy.

PRIOR ART

The preparation of spray-dried powders containing sodium carbonate, sodium sulphate and carboxylic polymers has been described in the literature. For example, EP 130 640A (Proctor & Gamble) describes in Example I a spray-dried detergent powder containing 16.6% surfactant, 23.8% sodium aluminosilicate, 13.1% sodium carbonate, an unspecified amount (apparently about 40%) of sodium sulphate and 1.5% polyacrylate. EP 108 429A (Proctor & Gamble) discloses spray-dried powders containing surfactant, sodium pyrophosphate, sodium silicate, sodium sulphate, sodium carbonate and polyacrylate. The polymers are said to give increased detergency on certain types of soil. No indication is given as to the order of addition of the various ingredients to the slurry. In the present invention, on the other hand, it is of critical importance that the polymer be added to the slurry not later than the relevant salt or salts are added, as explained above.

EP 108 429A (Proctor & Gamble) discloses in Example II a spray-dried detergent composition containing alkylbenzene sulphonate (16.6%), alkyl polyethoxy sulphate (7.1%), sodium pyrophosphate (58.8%), sodium carbonate (6.3%), sodium silicate (1.9%), sodium sulphate (1.9%), sodium polyacrylate of molecular weight 50,000 to 70,000 (1.8%), plus minor ingredients and water. About 1% of sodium polyacrylate of molecular weight 2000 is mixed with the anionic surfactant paste prior to adding the other components to the slurry. It is arguable that this procedure might have resulted in the formation of very small amounts of crystal-growth-modified sodium carbonate monohydrate and Burkeite, but the levels would have been too low to have any appreciable effect on the properties of the powder.

DEFINITION OF INVENTION

In a first aspect, the present invention provides a process for the production of a powder suitable for use as a granular detergent composition or a component thereof, which comprises the steps of:

(i) preparing an aqueous slurry comprising sodium carbonate, and optionally also comprising sodium sulphate in a weight ratio of sodium carbonate to sodium sulphate of at least 0.03:l, the total amount of sodium carbonate and (if present) sodium sulphate being at least 10% by weight based on the dried powder; an effective amount of a crystal growth modifier which is an organic material having at least three carboxyl groups in the molecule; and optionally one or more anionic and/or nonionic detergent-active compounds, one or more detergency builders and/or one or more further heat-insensitive detergent components; the crystal growth modifier being incorporated in the slurry not later than the sodium carbonate; whereby crystal growth-modified sodium carbonate monohydrtae and/or crystal-growth-modified Burkeite is or are formed in the slurry;

(ii) drying the slurry to form a powder;

(iii) optionally incorporating into the dried powder one or more detergent components in liquid form and/or mixing the dried powder with one or more solid detergent components.

The term "detergent components" is used here to denote any material that may be present in a detergent composition: it does not necessarily imply surface acitivity.

The present invention also provides a powder suitable for use as a base for a granular detergent composition or a component thereof, the powder being prepared by drying a slurry and consisting essentially of sodium carbonate, optionally together with sodium sulphate in a weight ratio (carbonate to sulphate) of at least 0.03:1, and an effective amount of a crystal growth modifier which is an organic material having at least three carboxyl groups in the molecule, the powder being characterised by a pore size distribution, as measured by mercury porosimetry, of at least 300 $cm^3$, preferably at least 350 $cm^3$, of pores $<3.5$ $\mu m$ per kilogram.

DESCRIPTION OF INVENTION

The process of the invention is concerned essentially with drying a slurry to form a powder. The preferred drying method is spray-drying, but other procedures that introduce porosity such as oven drying, drum drying or ring drying may also be used. For simplicity, however, the description that follows will refer to spray-drying.

The process of the invention can give a variety of products depending on the optional ingredients and additional process steps selected. All these products have in common a spray-dried inorganic matrix of crystal-growth-modified sodium carbonate and/or Burkeite, derived from sodium carbonate and (optionally) sodium sulphate amounting to at least 10% by weight of the dried powder obtained in step (ii), but not necessarily at least 10% by weight of the final product of step (iii). The pore size distribution of the final product will depend on any other materials present, whether incorporated in the slurry or postdosed. For example, certain components present in the slurry will fill the pores generated by spray-drying, and postdosed solids can alter the final pore size distribution by contributing porosity of their own.

As indicated above, it is of critical importance in the process of the invention that the crystal growth modifier be present in the slurry at a sufficiently early stage to influence the crystal growth of the sodium carbonate monohydrate and/or Burkeite. If no sodium sulphate is present, so that modification of sodium carbonate monohydgrate alone is in question, the modifier must be added to the slurry not later than the soda ash is added, and preferably before the addition of the soda ash. When both salts (carbonate and sulphate) are present, the crystal growth modifier must be incorporated not later than the sodium carbonate is added, and preferably not later than the addition of both salts.

In batch slurry-making, there is no difficulty in arranging for the ingredients to be added in the apprppriate order. In continuous slurry-making processes all components are added substantially simultaneously, but once the start-up period is over the inorganic salts (sodium carbonate and sodium sulphate) will in practice always encounter a slurry containing some crystal growth modifier.

When both sodium carbonate and sodium sulphate are to be incorporated in the slurry, crystal growth modification of Burkeite alone or of Burkeite and sodium carbonate monohydrate will be involved depending on the carbonate to sulphate ratio. This ratio must be at least 0.03:1 by weight, as previously indicated, in order to obtain a useful level of porosity; the ratio is preferably at least 0.1:1 and advantageously at least 0.37:1. This latter figure represent the stoichiometric ratio for Burkeite formation. Thus it is preferred that as much as possible of the sodium sulphate present be in the form of (modified) Burkeite. Excess sodium carbonate, if present, will itself be in crystal-growth-modified form.

When both salts (sodium carbonate and sodium sulphate) are to be included in the slurry, the preferred order of addition is for the sulphate to be added before the soda ash. This has been found to give a higher yield of Burkeite and the Burkeite thus formed appears to have a higher useful porosity. In this preferred method, the crystal growth modifier should be added to the slurry either before the addition of both salts, or after the addition of the sulphate and before the addition of the soda ash.

On drying the slurry, crystal-growth-modified Burkeite, which is an anhydrous material, survives unchanged in the dried powder. Crystal-growth-modified sodium carbonate monohydrate will generally lose some water of crystallisation on drying, depending on the drying conditions, but this does not adversely affect the porosity and indeed may introduce further useful porosity.

The simplest product of the invention is a predominantly inorganic base material produced by steps (i) and (ii) only of the process of the invention, from an aqueous slurry consisting essentially of water, the crystal growth modifier, sodium carbonate and if present, sodium sulphate. Such a product is defined above in the second paragraph of the "Definition of the Invention". This relatively simple system, useful either as the principal carrier material in a detergent composition or as a carrier material for one particular ingredient, may be used as a model for determining the preferred type and optimum level of crystal growth modifier to give the desired pore size distribution: pore size distribution may be measured by the recognised technique of mercury porosimetry. The same crystal growth modifier at the same level may then be used to produce more complex products of the invention, containing surfactants and other components commonly encountered in detergent compositions, incorporated via the slurry or postdosed as appropriate. As shown in the Examples below, pore size distribution as measured by mercury porosimetry has been shown to correlate well with capacity to take up and retain liquid detergent components such as nonionic surfactants.

We have found that the polycarboxylate crystal growth modifier cannot be defined generically in purely structural terms, and it is also difficult to predict how much will be required. The simple model system described above enables the crystal growth modifier to be defined functionally as an organic material having three or more carboxyl groups in the molecule, which, when incorporated at a suitable level in a slurry to which sodium carbonate, or sodium carbonate and sodium sulphate in a weight ratio of at least 0.03:1, is or are subsequently or simultaneously added, gives on drying a powder having a pore size distribution as defined above.

The crystal growth modifier is a polycarboxylate, Monomeric polycarboxylates, for example, salts of ethylendiaminetetraacetic acid, nitrilotriacetic acid and citric acid, may be used but the levels required are rather high, for example, 5 to 10% by weight based on the carbonate and, if present, sulphate. Preferred polycarboxylate crystal growth modifiers used in the invention are polymeric polycarboxylates. Amounts of from 0.1 to 20% by weight, preferably from 0.2 to 5% by weight, based on the total amount of sodium carbonate and (if present) sodium sulphate, are generally sufficient, but higher levels of polymer, for example, up to 60% by weight based on the specified salts, may be present in compositions of the invention (other than the model system mentioned above) for reasons other than crystal growth modification, for example, building, structuring or antiredeposition.

The polycarboxylate crystal growth modifier preferably has a molecular weight of at least 1000, advantageously from 1000 to 300,000, especially from 1000 to 250,000. Powders having especially good dynamic flow rates may be prepared using polycarboxylate crystal growth modifiers having molecular weights in the 3000 to 100,000 range, especially 3500 to 70,000 and more especially 10,000 to 70,000. All molecular weights quoted herein are those provided by the manufacturers.

Preferred crsytal growth modifiers are homopolymers and copolymers of acrylic acid or maleic acid. Of especial interest are polyacrylates, acrylic acid/maleic acid copolymers, and acrylic phosphinates.

Suitable polymers, which may be used alone or in combination, include the following:

salts of polyacrylic acid such as sodium polyacrylate, for example Versicol (Trade Mark) E5 E7 and E9 ex Allied Colloids, average molecular weights 3500, 27,000 and 70,000; Narlex (Trade Mark) LD 30 and 34 ex National Adhesives and Resins Lts, average molecular weights 5000 and 25,000 respectively; Acrysol (Trade Mark) LMW-10, LMW-20, LMW-45 and A-1N ex Rohm & Haas, average molecular weights 1000, 2000, 4500 and 60,000; and Sokalan (Trade Mark) PAS ex BASF, average molecular weight 250,000;

ethylene/maleic acid copolymers, for example. the EMA (Trade Mark) series ex Monsanto;

methyl vinyl ether/maleic acid copolymers, for example Gantrez (Trade Mark) AN119 ex GAF Corporation;

acrylic acid/maleic acid copolymers, for example, Sokalan (Trade Mark) CP5 ex BASF; and acrylic phosphinates, for example, the DKW range ex National Adhesives and Resins Ltd or the Belsperse (Trade Mark) range ex Ciba-Geigy AG, as disclosed in EP 182 411 A (Unilever).

Mixtures of any two or more crystal growth modifiers may if desired be used in the compositions of the invention.

The sodium carbonate used in the process and carrier material of the invention may be of any type. Synthetic light soda ash has been found to be especially preferred; natural heavy soda ash is intermediate, while synthetic granular soda ash is the least preferred raw material. All grades of sodium sulphate are suitable for use in the ivention, provided that they are not heavily contaminated with other salts such as calcium sulphate.

Spray-dried crystal-growth-modified sodium carbonate monohydrate and Burkeite in accordance with the invention are excellent bases for detergent powders: they display good flow properties, and (particularly in the case of Burkeite) resistance to caking. These materials may thus be used with advantage as bases for detergent powders in which all components are incorporated in the slurry. Their especial virtue, however, lies in their capacity to take up and hold large quantities of liquid components, so their use is of particular benefit in compositions which include an ingredient that is postdosed in liquid form. That indgredient may be inherently liquid at processing temperatures, or it may first be liquefied by melting or dissolving in a solvent. Examples of such ingrdients are perfumes, dyes, oils, bleach precursors, peracids and even aqueous liquids; but the invention is of especial interest in connection with nonionic surfactants.

Nonionic surfactants preferably used in the process and compositions of the invention are the primary and secondary alcohol ethoxylates, especially the $C_{12}$–$C_{15}$ primary and secondary alcohols ethoxylated with an average of from 3 to 20 moles of ethylene oxide per mole of alcohol. The use of the carrier material of the invention is especially advantageous for nonionic surfactants having a degree of ethoxylation of 10EO or below, which are generally liquid at room temperature and often cannot be spray-dried because they give rise to unacceptable levels of tower emission ("blue smoke" or "pluming").

The crystal-growth-modified sodium carbonate and Burkeite of the invention provide an excellent route for incorporating liquid nonionic surfactants into detergents powders. A spray-dried base is first prepared (steps (i) and (ii) of the process of the ivention) and the nonionic surfactant is then sprayed on (step (iii) of the process of the invention).

This concept can be utilised in various ways in a detergent composition. They spray-dried powder prepared in step (ii) may be the principal base or carrier of the composition and incorporate any other heat-insensitive components, for example, anionic surfactants or builders, that are to be included in the product. In this case, admixture with othe solid components is optional, and may be omitted altogether, for example, in a powder containing no bleaching components or enzymes.

Alternatively, the spray-dried powder of step (ii) may be a predominantly inorganic carrier intended specially as a vehicle for the nonionic surfactant, and may perhaps form only a minor part of the final product. In step (iii) it will then be mixed with the main product, which might itself have been spray-dried in a separate operation.

Various intermediate options between these two extreme positions are also possible.

This is equally true when the liquid or liquefiable component to be carried is a perfume or any other appropriate detergent component.

In all these products, the total level of sodium carbonate and (if present) sodium sulphate is at least 10% by weight of the dried powder, but the total level of these salts in a final product according to the invention may vary between wide limits. In products where the modified salt is the principal carrier in the composition, the level is preferably at least 15% by weight and more preferably at least 20% by weight, but much lower levels may be encountered when the crystal-growth-modified material is used only as a carrier for a minor ingredient.

The amount of crystal-growth-modifying polymer in such products may be higher than the level required for effective crystal growth modification, because the polymer may also fulfill other functions, such as structuring, in the powder. This is especially likely in compositions containing only low levels of the relevant salts (sodium carbonate, sodium sulphate) based on the final product.

Detergent compositions in accordance with the present invention may contain any indgredients conventionally present, notably anionic surfactants, both soap and synthetic; nonionic surfactants, as already discussed; detergency builders; alkali metal silicates; antiredeposition agents; antiincrustation agents; fluorescers; enzymes; bleaches, bleach precursors and bleach stabilisers; perfumes; and dyes. These may be added to the aqueous slurry—step (i)—or post-dosed into the spray-dried powder—step (iii)—according to their known suitability for undergoing spray-drying processes.

Anionic surfactants are well-known to those skilled in the detergents arts. Examples include alkylbenzene sulphonates, particularly sodium alkylbenzene sulphonates having an average chain length of $C_{12}$; primary and secondary alcohol sulphates, particularly sodium $C_{12}$–$C_{15}$ primary alcohol sulphates; olefin sulphonates; alkane aulphonates; and fatty acid ester sulphonates.

It may also be desirable to include one or more soaps of fatty acids. The soaps which can be used are preferably sodium soaps derived from naturally occurring fatty acids, for example the fatty acids from coconut oil, beef tallow, or sunflower oil.

Anionic surfactants, both soap and non-soap, will generally be incorporated via the slurry—step (i)—rather than post-dosed.

The sodium carbonate present in the detergent composition acts as a detergency builder, but it may nevertheless be advantageous to include other builders. Phosphate builders, notably alkali metal tripolyphosphates, orthophosphates and pyrophosphates, may be present, but the invention is of especial applicability to zero-phosphorous compositions. Non-P builders that may be present include, but are not restricted to, crystalline and amorphous aluminosilicates, soaps, sulphonated fatty acid salts, citrates, nitrilotriacetates and carboxymethyloxysuccinates; it is within the scope of the invention for the amount of such other builders to exceed the amount of sodium carboante present. Calcite may be included as a crystallisation seed to increase the builder efficiency of the sodium carbonate.

The foregoing description has been concerned primarily with detergent compositions suitable for washing fabrics. Compositions in accordance with the invention may also find use, for example, in laundry pretreatment products, household cleaning products and personal products (toiletries), pesticides, pharmaceutical products, agricultural products and industrial products: many possible uses will suggest themselves to one skilled in the art. In all fields of use, the product may simply consist of the predominantly inorganic carrier material (modified sodium carbonate and/or Burkeite) having a liquid or liquefiable material sorbed thereon, or other materials may be incorporated via the slurry, by postdosing, or both; and the spray-dried predominantly inorganic carrier material characteristic of the invention may form a major or minor part of the product.

While the foregoiong description has been concerned entirely with spray-dried powders, the invention is also applicable, as previously indicated, to products dried by other methods that introduce porosity, for example, air drying, oven drying, drum drying, ring drying, freeze drying, solvent drying or microwave drying.

PREFERRED EMBODIMENTS OF THE INVENTION

As indicated previously, one highly preferred field of use for the inorganic carrier material of the invention is in fabric washing detergent powders. This preferred class of compositions according to the invention falls into two subclasses: powders in which the inorganic carrier material of the invention is the principle base or matrix material and is present at a substantial level; and powders in which the predominantly inorganic carrier material is used in an "adjunct", that is to say, it is used as a carrier material for a particular ingredient, such as a liquid nonionic surfactant, and the adjunct is post-dosed toa base powder of a different type. In the second case the inorganic carrier material of the invention may be present at a relatively low level.

Examples of detergent compositions utilising the inorganic carrier material of the invention as the prinicpal base or matrix of the powder include the following:

, (i) Zero-P carbonate-built powders

These may typically contain the following amounts of the principal ingedients:

| | weight % |
|---|---|
| Surfactant (nonionic and/or anionic) | 5–40 |
| Sodium carbonate | 20–70 |
| Sodium sulphate | 0–50 |
| Crystal growth modifier (polymeric polycarboxylate) | 0.1–10 |
| Sodium silicate | 0–25 |

A detergent powder intended as a very low-sudsing product for washing machine use may typically contain nonionic surfactant only, at a level of 5 to 30% by weight. A medium-sudsing product suitable for use in top-loading washing machines may typically contain a binary surfactant system (anionic/nonionic) at a level of 5 to 40% by weight. A product intended for hand-washing may contain a relatively high level of anionic surfactant alone (10–40%).

(ii) Low or zero-P aluminosilicate-built powders

These may typically contain the following amounts of the principal ingredients:

| | Weight % |
|---|---|
| Surfactants (anionic, nonionic, | 5–40 |

-continued

| | Weight % |
|---|---|
| cationic, zwitterionic) | |
| Sodium aluminosilicate | 10–60 |
| Sodium tripolyphosphate | 0–25 |
| Sodium orthophosphate | 0–20 |
| Sodium nitrilotriacetate | 0–20 |
| Sodium carbonate | 2–20. |
| Sodium sulphate | 0–50 |
| Crystal growth modifier (polymeric polycarboxylate) | 0.05–10 |
| Sodium silicate | 0–10 |
| Bleach ingredients | 0–30 |
| Enzyme, lather suppressor etc | 0–10 |

Zero-P aluminosilicate-built powders containing the inorganic carrier material of the invention as a particle structurant may typically contain the following amounts of the principal ingredients:

| | % |
|---|---|
| Surfactant (nonionic and/or anionic) | 5–40 |
| Sodium aluminosilicate | 10–60 |
| Sodium carbonate | 5–20 |
| Sodium sulphate | 0–50 |
| Crystal growth modifier (polymeric polycarboxylate) | 0.05–10 |
| Sodium silicate | 0–10 |

Examples of detergent compositions utilising the inorganic carrier material of the invention in an adjunct includes the following:

(iii) Phosphate-built powders

These may typically contain the following amounts of the principal ingredients:

| | Weight % |
|---|---|
| Surfactants (anionic, nonionic, cationic, zwitterionic) | 5–40 |
| Sodium tripolyphosphate | 5–40 |
| Sodium carbonate (in adjunct) | 1–10 |
| Sodium carbonate (other) | 0–10 |
| Sodium sulphate (in adjunct) | 0–25 |
| Sodium sulphate (other) | 0–30 |
| Crystal growth modifier (polymeric polycarboxylate) | 0.05–5 |
| Sodium silicate | 0–15 |
| Bleach ingredients | 0–30 |
| Enzyme, lather suppressor etc | 0–10 |

Here the modified sodium carbonate monohydrate or Burkeite will typically be used as a carrier for nonionic sufactant. An adjunct will be prepared by spraying liquid or liquefied nonionic surfactant onto a spray-dried carrier material according to the invention, and the adjunct is then postdosed to a base powder containing anionic surfactant, possibly nonionic surfactant, phosphate builder, sodium silicate and other heat-sensitive ingredients, prepared in a separate spray-drying operation. The adjunct may, for example, contain from 5 to 40% by weight of nonionic surfactant and from 60 to 95% by weight of crystal-growth-modified inorganic salts. The adjunct may, for example, constitute from 5 to 20% by weight of the final powder.

In this embodiment, the adjunct carrier may with advantage contain minor amounts of other heat-resistant ingredients. Sodium silicate, for example, reduces the friability of the carrier material and aids in handling; a small amount of anionic surfactant increases powder porosity and increases slurry stability; and a small amount of nonionic surfactant improves slurry pumpability and atomisation.

Of course, the adjunct carrier of the invention may also be used to introduce liquid ingredients other than nonionic surfactants into the composition.

(iv) Low or zero-P aluminosilicate-built powders

These may typically contain the following amounts of the principle indgredients:

| | Weight % |
|---|---|
| Surfactants (anionic, nonionic cationic, zwitterionic) | 5–40 |
| Sodium aluminosilicate | 10–60 |
| Sodium tripolyphosphate | 0–25 |
| Sodium orthophosphate | 0–20 |
| Sodium nitrilotriacetate | 0–20 |
| Sodium carbonate (in adjunct) | 1–10 |
| Sodium carbonate (other) | 0–10 |
| Sodium sulphate (in adjunct) | 0–25 |
| Sodium sulphate (other) | 0–30 |
| Crystal growth modifier (polymeric polycarboxylate) | 0.05–10 |
| Sodium silicate | 0–10 |
| Bleach ingredients | 0–30 |
| Enzyme, lather suppressor etc. | 0–10 |

The comments above under (iii) on adjuncts also apply to aluminosilicate-built powders.

EXAMPLES

The invention will now be illustrated by the following non-limiting Examples, in which parts and percentages are by weight.

EXAMPLE 1

A first slurry was prepared by mixing soda ash (50% by weight) with an aqueous solution (50% by weight) of sodium polyacrylate of molecular weight 25,000 (Narlex LD 34 ex National Adhesives and Resins Ltd) (1.5% by weight of polymer, based on the sodium carbonate). A second (control) slurry containing no polymer was also prepared and the slurries were spray-dried to give powders.

The pore size distribution of each powder was determined by mercury porosimetry, using a Scanning Porosimeter, Model SP100, ex Quantachrome Corporation. The technique is described in "Powder Surface Area and Porosity" by Lowell and J E Shields, second edition, Chapman and Hall, N.Y., 1984, pages 84–120.

The capacity of each powder to take up and retain a liquid nonionic surfactant (Synperonic (Trade Mark) A7 ex ICI, a $C_{12}$–$C_{15}$ primary alcohol mix with an average degree of ethoxylation of 7) was also determined by the following method: preweighed doses of liquid nonionic surfactant coloured with a dye were mixed successively with a weighed sample of the powder; after each addition the powder sample was compressed between filter papers using a set weight for a set period; the filter papers were examined for staining; and the procedure was continued until visible staining of the filter papers was observed.

The results of the two test methods were as follows:

| | A (control) | 1 (with polymer) |
|---|---|---|
| Hg porosimetry: $cm^3$ of pores $<3.5$ μm per kg powder | 120 | 615 |
| Nonionic surfactant | 150 | 650 |

-continued

| | A (control) | 1 (with polymer) |
|---|---|---|
| uptake/retention ($cm^3/kg$) | | |

These results show very clearly the benefits of modifying the crystal growth of sodium carbonate monohydrate.

EXAMPLES 2 to 5

Slurries containg sodium carbonate (12.5% by weight), sodium sulphate (34% by weight) and water (53.5% by weight) were prepared and spray-dried to give powders containing 26.6% sodium carbonate, 71.4% sodium sulphate and 2.0% moisture: the carbonate to sulphate ratio was 0.37;1. Sodium polyacrylate of molcular weight 3500 (Versicol E5 ex Allied Colloids) was added at various stages in the slurry-making process, and at various levels, as shown in the Table which follows. As in Example 1, the pore size distribution of each powder was determined by mercury porosimetry, and the capacity to hold a liquid nonionic sufactant was determined by titration.

Comparative Example B was a control containing no polymer, and Comparative Example C was a control containing 0.3% polymer that had been added to the slurry after the salts: it will be seen that only a very small improvement in useful porosity was achieved when this order of addition was adopted. Addition of the same level of polymer to the slurry before incorporation of the salts (Example 2), on the other hand, nearly doubled the nonionic surfactant retention capacity in comparison with the no-polymer control B. Use of a higher level of polymer (1.0%: Example 4) caused further improvement.

| Example | Polymer level (weight % on salts) | Order of addition of polymer | Liquid nonionic retention capacity $cm^3/kg$ | Pores <3.5 μm (Hg porosimetry) $cm^3/kg$ |
|---|---|---|---|---|
| B | — | — | 230 | 250 |
| 2 | 0.3 | Before salts | 390 | 390 |
| C | 0.3 | After salts | 250 | 230 |
| 3 | 0.75 | Before salts | 420 | 430 |
| 4 | 1.0 | Before salts | 490 | 510 |
| 5 | 5.0 | Before salts | 440 | 450 |

80 parts of the spray-dried powder of Example 2 were able to take up 20 parts of sprayed-on nonionic surfactant while retaining the properties of a free-flowing powder. This powder had the following physical properties:

| | |
|---|---|
| Dynamic flow rate | 104 ml/s |
| Compressibility | 8% v/v |
| Ong value | 45 mg |

The Ong value is a recognised measure of the tendency of nonionic surfactants to "bleed out" of a powder: it represents the amount of nonionic surfactant absorbed during a three-week storage period at 37° C. by preweighed filter paprers placed at the top and bottom of a powder column. Values below 80 mg are considered to be acceptable.

75 parts of the spray-dried powder of Example 4 were able to take up 25 parts of sprayed-on nonionic surfactant, to give a powder having the following properties:

| | |
|---|---|
| Dynamic flow rate | 90 ml/s |
| Compressibility | 11% v/v |
| Ong value | 73 mg |

The control powder B was able to take only 11 parts of nonionic surfactant per 89 parts of powder, and even at this level the powder properties were inferior:

| | |
|---|---|
| Dynamic flow rate | Nil |
| Compressibility | 16% v/v |
| Ong value | 250 mg |

The control powder C behaved similarly.

EXAMPLES 6 & 7

The procedure of Example 4 was repeated using the same level (1.0%) of sodium polyacrylates (Versicol E7 and E9) of molecular weights 27,000 and 70,000, and the liquid nonionic surfactant retention capacities were determined. The results were as follows:

| Example | Molecular weight of sodium polyacrylate | Liquid nonionic retention capacity, $cm^3/kg$ |
|---|---|---|
| 4 | 3500 | 490 |
| 6 | 27 000 | 510 |
| 7 | 70 000 | 515 |

It will be seen that the nonionic surfactant retention capacity increased slightly with increased molecular weight of the polymer.

EXAMPLES 8 & 9

These Examples show the benefit of including sodium silicate in spray-dried crystal-growth-modified Burkeite: decreased friability resulting from increased particle strength.

Two spray-dried powders were prepared to the following formulations (%), the sodium polyacrylate being incorporated in the slurry before the sodium carbonate and sodium sulphate:

| | 8 | 9 |
|---|---|---|
| Sodium sulphate | 69.2 | 65.6 |
| Sodium carbonate | 25.8 | 24.4 |
| Sodium silicate | — | 5.0 |
| Nonionic surfactant (Synperonic A7) | 1.0 | 1.0 |
| Sodium polyacrylate (as Example 1: molecular weight 25 000) | 2.0 | 2.0 |
| Moisture | 2.0 | 2.0 |

-continued

| | 8 | 9 |
|---|---|---|
| | 100.0 | 100.0 |

The polymer levels based on sodium carbonate and sodium sulphate were 2.1% and 2.2% respectively. The sodium carbonate to sodium sulphate ratio was 0.37:1 for both powders.

The friabilities of the two powders themselves, and of the powders while carrying nonionic surfactant (23% nonionic surfactant, 77% carrier), were determined by measuring the increase in the percentage by weight of particles <150 μm present after a standard attrition test: a friability figure above 20% is unacceptable for pneumatic powder handling.

The liquid nonionic surfactant retention capcaity was slightly reduced by the presence of sodium silicate, but not to be detrimental extent.

| | Friability (%) | | Liquid |
|---|---|---|---|
| Example | Base | Base plus nonionic surfactant | nonionic surfactant retention capacity ($cm^3$/kg) |
| 8 | 45 | 20 | 510 |
| 9 | 15 | 6 | 485 |

EXAMPLE 10

This example shows the benefit of including a small amount of anionic surfactant (linear alklybenzene sulphonate, sodium salt) in spray-dried crystal-growth-modified Burkeite.

A slurry containing sodium polyacrylate as in Example 1 (1.0%), sodium carbonate (12.5%), sodium sulphate (34%), anionic surfactant (0.5%), and water (53.0%) was prepared, the sodium polyacrylate being introduced first, and spray-dried to give a powder. The amount of polymer was 2.15% based on sodium carbonate and sodium sulphate, and the sodium carbonate to sodium sulphate ratio was 0.37:1. The powder density and liquid nonionic surfactant retention capacity were compared with those of Example 6 containing no anionic surfactant:

| | 10 | 6 |
|---|---|---|
| Powder density (g/liter) | 500 | 550 |
| Liquid nonionic surfactant retention capacity ($cm^3$/kg) | 560 | 510 |

The slurry of Example 6 started to separate after 30–40 minutes, but the slurry of Example 10 was stable for 5 hours.

EXAMPLE 11

Crystal-growth-modified Burkeite containing sodium silicate, alkylbenzene sulphonate and a nonionic surfactant was prepared by a batch slurrymaking and spray-drying process to the following formulation (%):

| | |
|---|---|
| Sodium polyacrylate (molecular weight 25 000) | 2.0* |
| Sodium sulphate | 65.5 |
| Sodium carbonate | 24.5 |
| Nonionic surfactant (Synperonic A7) | 1.0 |

-continued

| | |
|---|---|
| Anionic surfactant (alkylbenzene sulphonate) | 0.5 |
| Sodium silicate | 4.5 |
| Moisture | 2.0 |
| | 100.0 |

*2.2% based on sodium sulphate + sodium carbonate.

The sodium carbonate to sodium sulphate ratio was 0.37:1.

The order of addition of ingredients to the slurry-making vessel (crutcher) was as follows: water to 85° C., sodium polyacrylate, sodium sulphate, sodium carbonate, sodium silicate, nonionic surfactant, anionic surfactant.

This material was highly suitable as a carrier or base for an adjunct, for example, a nonionic surfactant adjunct for addition to a phosphate-built or aluminosilicate-built detergent powder (see Example 24 and 25 below).

EXAMPLE 12

Crystal-growth-modified Burkeite containing sodiumi silicate and nonionic surfactant was prepared by a continuous slurrymaking process, followed by spray-drying, to the formulation (%) below. By continuous slurrymaking is meant a process in which components are fed continuously and substantially simultaneously to the slurry-making vessel, while mixed slurry is removed to the spray tower at a rate that maintains a substantially constant volume in the vessel.

| | |
|---|---|
| Sodium sulphate | 67.0 |
| Sodium carbonate | 25.0 |
| Sodium polyacrylate (molecular weight 25 000) | 1.5* |
| Sodium silicate | 3.0 |
| Nonionic surfactant (Synperonic A7) | 1.0 |
| Water | 2.5 |
| | 100.0 |

*1.63% based on sodium sulphate + sodium carbonate.

The sodium carbonate to sodium sulphate ratio was 0.37:1.

The product had a bulk density of 550 g/liter, a dynamic flow rate of 90 ml/s and a compressibility of 5%. It was able to take up 450 ml of liquid nonionic surfactant per kg.

An adjunct consisting of 23% by weight of liquid nonionic surfactant and 77% by weight of the spray-dried product was stable and had excellent powder properties.

EXAMPLES 13 and 14

High-sudsing carbonate-built powders suitable for washing fabrics by hand were prepared from the ingredients listed in the following Table, the percentages (by weight) being based on the final product. Compositions 13 and 14 were in accordance with the invention while Comparative Composition D was a control containing no polymer.

| | 13 | 14 | D |
|---|---|---|---|
| Sodium polyacrylate (molecular weight 25 000) | 1.0* | — | — |
| Methyl vinyl ether/maleic anhydride copolymer (Gantrez | — | 0.5** | — |

-continued

| | 13 | 14 | D |
|---|---|---|---|
| (Trade Mark) AN 119 ex GAF Corporation) | | | |
| Sodium sulphate | 3.0 | 3.0 | 3.0 |
| Sodium carbonate | 45.0 | 45.0 | 45.0 |
| Sodium silicate | 12.0 | 12.0 | 12.0 |
| Linear alkylbenzene sulphonate (Petrelab (Trade Mark) 550 ex Petresa), sodium salt | 28.0 | 28.0 | 28.0 |
| Minor ingredients | 2.0 | 2.5 | 3.0 |
| Moisture | 9.0 | 9.0 | 9.0 |

*2.1% based on sodium sulphate + sodium carbonate
**1.04% based on sodium sulphate + sodium carbonate The sodium carbonate to sodium sulphate ratio was 15:1 for both powders.

For each powder slurries were prepared, at 39% moisture content, at about 80° C., the crystal growth modifiers being incorporated in the slurries before the sodium carbonate and sodium sulphate.

The final powders had the following properties:

| | 13 | 14 | D |
|---|---|---|---|
| Dynamic flow rate (ml/s) | 110 | 115 | 96 |
| Compressibility (% v/v) | 25 | 29 | 35 |
| Powder caking (%) after storage for 6 weeks in non-laminated cartons under conditions of 28° C. and 70% RH | nil | 15 | 35 |

EXAMPLE 15

Very low-sudsing zero-P carbonate-built powders suitable for use in automatic washing machines were prepared from the ingredients listed in the following Table, the percentages (by weight) being based on the final product. Composition 15 was in accordance with the invention while Comparative Composition E was a control containing no polymer. In both powders the ratio of sodium carbonate to sodium sulphate was 0.79:1. The sodium polyacrylate was introduced into the slurry before the sodium carbonate and sodium sulphate.

| | E | 15 |
|---|---|---|
| (a) Via the slurry | | |
| Sodium polyacrylate as in Examples 2 to 5 (molecular weight 3500) | — | 0.3* |
| Sodium sulphate | 42.0 | 41.7 |
| Sodium carbonate (as soda ash) | 33.0 | 33.0 |
| Sodium silicate | 10.0 | 10.0 |
| Minor ingredients (fluorescer, antiredeposition agents) | 0.4 | 0.4 |
| Nonionic surfactant as in Examples 1 to 7 | 2.6 | 2.6 |
| Moisture | 4.0 | 4.0 |
| (b) Postdosed | | |
| Nonionic surfactant as in Examples 1 to 7, sprayed on | 6.0 | 6.0 |
| Minor ingredients (perfume etc) | 2.0 | 2.0 |

*0.40% based on sodium sulphate + sodium carbonate.

Slurries of 30% moisture content were prepared by mixing the ingredients given above, the crystal-growth-modifying polymer being incorporated in the slurry before addition of the inorganic salts. The slurries were spray-dried to form powders of 4% moisture content, and nonionic surfactant was postdosed by spraying. The properties of the two powders were as follows:

| | E | 15 |
|---|---|---|
| Dynamic flow rate (ml/s) | nil | 104 |
| Compressibility (% v/v) | 11 | 10 |
| Ong value, mg | 341 | 49 |
| Powder caking (%) after storage in wax-laminated cartons for 6 weeks at 28° C./70% RH | 25 | nil |
| External staining of wax-laminated cartons after storage for 6 weeks at 28° C./70% RH | visible | none visible |

EXAMPLE 16

Medium-sudsing zero-P carbonate-built powders suitable for use in top-loading washing machines were prepared from the ingredients in the following Table, all of which were incorporated via the slurry. The sodium polyacrylate was introduced before the sodium carbonate and the sodium sulphate.

| | 16 | F |
|---|---|---|
| Sodium polyacrylate (molecular weight 25 000) | 0.3* | — |
| Sodium sulphate | 28.0 | 28.3 |
| Sodium carbonate | 35.0 | 35.0 |
| Sodium silicate | 12.0 | 12.0 |
| Sodium linear alkylbenzene sulphonate | 11.0 | 11.0 |
| Sodium alkyl ether sulphate | 5.0 | 5.0 |
| Minor ingredients | 1.7 | 1.7 |
| Moisture | 7.0 | 7.0 |

*0.48% based on sodium sulphate + sodium carbonate.

The sodium carbonate to sodium sulphate ratio was 1.25:1.

The powder properties were as follows:

| | 16 | F |
|---|---|---|
| Dynamic flow rate (ml/s) | 86 | 65 |
| Compressibility (% v/v) | 25 | 47 |
| Powder caking after storage in wax-laminated cartons for 6 weeks at 28° C. and 70% RH (%) | 10 | 25 |

EXAMPLES 17-19

A series of powders similar to that of Example 16 was prepared using higher levels (1.0% by weight based on the whole powder), of sodium polyacrylates of different molecular weights: in each case the sodium polyacrylate was introduced into the slurry before the sodium carbonate and sodium sulphate. The compositions are shown in the Table.

The sodium carbonate to sodium sulphate ratio was 0.51:1 for each powder.

The powder properties were as follows:

| | G | 17 | 18 | 19 |
|---|---|---|---|---|
| Polymer molecular weight | — | 4500 | 10 000 | 60 000 |
| Dynamic flow rate (ml/s) | 32 | 56 | 72 | 87 |
| Compressibility (% v/v) | 40 | 19 | 19 | 25 |

It will be seen that dynamic flow rates increase significantly with increasing polymer molecular weight, while compressibility is apparently less sensitive but appears to deteriorate somewhat at higher polymer molecular weight values.

| EXAMPLES 17 TO 19 | | | | |
|---|---|---|---|---|
| | G | 17 | 18 | 19 |
| Sodium polyacrylate: | | | | |
| mol. wt. 4500 | — | 1.0* | — | — |
| mol. wt. 10 000 | — | — | 1.0* | — |
| mol. wt. 60 000 | — | — | — | 1.0* |
| Sodium carbonate | 19.0 | 19.0 | 19.0 | 18.5 |
| Sodium sulphate | 37.0 | 37.0 | 37.0 | 36.0 |
| Sodium silicate | 20.0 | 20.0 | 20.0 | 20.0 |
| Sodium linear alkylbenzene sulphonate | 11.0 | 11.0 | 11.0 | 12.0 |
| Sodium alkyl ether sulphate | 5.0 | 5.0 | 5.0 | 6.0 |
| Minor ingredients, water | to 100 | to 100 | to 100 | to 100 |

*1.8% based on sodium carbonate + sodium sulphate

EXAMPLE 20

A powder similar to those of Examples 17 to 19 but built with sodium carbonate and zeolite was prepared, the sodium polyacrylate being incorporated in the slurry before the sodium carbonate and sodium sulphate. The sodium carbonate to sodium sulphate ratio was 0.54:1.

| | % |
|---|---|
| Sodium polyacrylate, mol. wt. 10 000 | 1.0* |
| Sodium carbonate | 15.0 |
| Sodium sulphate | 28.0 |
| Zeolite | 20.0 |
| Sodium silicate | 10.0 |
| Sodium linear alkylbenzene sulphonate | 12.0 |
| Sodium alkyl ether sulphate | 6.0 |
| Minor ingredients, water | to 100 |
| Dynamic flow rate (ml/s) | 86 |
| Compressibility (% v/v) | 12 |

*2.3% based on sodium carbonate + sodium sulphate

EXAMPLES 21 and 22

Powders containing zeolite as principal builder and crystal-growth-modified Burkeite as a particle structurant were prepared by a combination of spray-drying and postdosing. The particle structurant system consisted of sodium silicate (at a low level) and sodium succinate in addition to modified Burkeite.

The slurry moisture contents were 49% by weight for Composition 21 and 47% by weight for Composition 22 and H. The sodium polyacrylate used in Examples 21 and 22 was incorporated in the slurry before the sodium carbonate and sodium sulphate.

The ingredients were as follows:

| | 21 | 22 | H |
|---|---|---|---|
| (a) Via slurry | | | |
| Sodium polyacrylate (molecular weight 5000) | 0.1[1] | 0.15[2] | — |
| Sodium sulphate | 11.2 | 20.3 | 20.3 |
| Sodium carbonate | 5.0 | 10.0 | 10.0 |
| Sodium succinate | 2.0 | 1.0 | 1.0 |
| Sodium silicate | 5.0 | 5.0 | 5.0 |
| Zeolite | 35.0 | 32.0 | 32.0 |

-continued

| | 21 | 22 | H |
|---|---|---|---|
| Linear alkylbenzene sulphonate as in Example 13 | 20.0 | 18.0 | 18.0 |
| Nonionic surfactant as in Examples 1 to 7 | 1.0 | — | — |
| Hardened tallow soap | 1.0 | — | — |
| Minor ingredients (fluorescer, antiredeposition agent, etc) | 2.5 | 2.5 | 2.65 |
| Moisture | 9.0 | 9.0 | 9.0 |
| | 91.8 | 97.95 | 97.95 |
| Ratio carbonate:sulphate | 0.45 | 0.49 | 0.49 |
| (b) Postdosed | | | |
| Nonionic surfactant as in Examples 1 to 7, sprayed on | 1.0 | — | — |
| Sodium carbonate (as granular soda ash) | 5.0 | — | — |
| Minor ingredients (enzyme, perfume, etc) | 2.2 | 2.05 | 2.05 |
| | 100.0 | 100.0 | 100.0 |

[1]0.6% based on sodium sulphate + sodium carbonate
[2]0.5% based on sodium sulphate + sodium carbonate.

The final powders had the following properties after 6 weeks' storage at 28° C./70% RH:

| | 21 | 22 | H |
|---|---|---|---|
| Dynamic flow rate (ml/s) | 88 | 89 | 72 |
| Compressibility (% v/v) | 29 | 29 | 45 |
| Insolubles | — | 0.5 | 21 |

The greatly reduced insolubles level of Composition 22 as compared with Comparative Composition H will be noted.

EXAMPLE 23

This Example illustrates the use of crystal-growth-modified Burkeite in a high-sudsing detergent powder intended for handwashing, containing a high level of anionic surfactant and built with sodium tripolyphosphate.

Powders of the following formulations (%) were prepared by slurry-making and spray-drying, the sodium polyacrylate in Composition 23 being added to the slurry before the sodium carbonate and sodium sulphate:

| | 23 | J |
|---|---|---|
| Sodium linear alkylbenzene sulphonate | 20.0 | 20.0 |
| Sodium tripolyphosphate | 22.0 | 22.0 |
| Sodium silicate | 10.0 | 10.0 |
| Sodium carbonate | 8.0 | 8.0 |
| Sodium sulphate | 27.3 | 27.8 |
| Sodium polyacrylate (molecular weight 25 000) | 0.5* | — |
| Minor ingredients (fluorescer, antiredeposition agent etc.) | 2.2 | 2.2 |
| Moisture | 10.0 | 10.0 |
| | 100.0 | 100.0 |

*1.42% based on sodium carbonate and sodium sulphate. Ratio sodium carbonate:-sodium sulphate 0.29:1

The properties of the powders were as follows:

| | 23 | J |
|---|---|---|
| Bulk density (g/liter) | 370 | 330 |
| Dynamic flow rate (ml/s) | 86 | 77 |

-continued

| | 23 | J |
|---|---|---|
| Compressibility (% v/v) | 20 | 31 |
| Powder caking (%) after 6 weeks storage in non-laminated cations at 30° C./80% RH | 10 | 30 |

EXAMPLE 24

This Example illustrates the use of crystal-growth-modified Burkeite as carrier material for an adjunct carrying nonionic surfactant, in a low-sudsing phosphate-built powder suitable for use in a front-loading automatic washing machine.

23 parts of liquid nonionic surfactant were sprayed onto 77 parts of the spray-dried crystal-growth-modified Burkeite of Example 11. This adjunct was then used in the preparation of a detergent powder (Composition 24) by mixing with a spray-dried base powder and with bleach ingredients. A control powder (Composition K) was also prepared, containing the same level of nonionic surfactant introduced via the slurry. The formulations are shown in the Table below.

| | 24 | K |
|---|---|---|
| Sodium linear alkylbenzene sulphonate | 9.0 | 9.0 |
| Nonionic surfactant | 1.0 | 4.0 |
| Sodium tripolyphosphate | 21.5 | 21.5 |
| Sodium sulphate | 22.1 | 29.4 |
| Alkaline sodium silicate | 5.5 | 5.5 |
| Minor ingredients (fluorescer, antiredeposition agent etc.) | 3.3 | 3.3 |
| Moisture | 8.0 | 8.0 |
| Total base powder | 70.4 | 80.7 |
| Carrier as in Example 11 | 10.0 | — |
| Nonionic surfactant | 3.0 | |
| Total adjunct | 13.0 | — |
| Bleach ingredients (sodium perborate, TAED, stabiliser) and minor ingredients (enzyme, lather suppressor etc) | 11.6 | 11.6 |
| Sodium carbonate | 5.0 | 7.7 |
| TOTAL COMPOSITION | 100.00 | 100.00 |

The properties of the final powders were as follows:

| | 24 | K |
|---|---|---|
| Dynamic flow rate (ml/s) | 100 | 80 |
| Compressibility (% v/v) | 15 | 25 |
| Cohesion test value (kg) | 0.5 | 2.0 |
| Bulk density (g/liter) | 500 | 530 |

Use of the adjunct to carry the nonionic surfactant increased the dynamic flow rate of the powders, and decreased both compressibility and cohesivity.

EXAMPLE 25

This Example illustrates the use of crystal-growth-modified Burkeite as the carrier for a nonionic surfactant adjunct in a low-sudsing zeolite-built zero-P powder suitable for use in a front-loading automatic washing machine. The adjunct used was that of Example 24, and it was used in the preparation of a detergent powder (Composition 25) by mixing with a spray-dried base powder and with bleach ingredients. A control powder (Composition L) was also prepared, containing the same level of nonionic surfactant introduced via the slurry. The formulations are shown in the Table below.

| | 25 | L |
|---|---|---|
| Sodium linear alkylbenzene sulphonate | 9.0 | 9.0 |
| Nonionic surfactant | 1.0 | 4.0 |
| Zeolite HAB A40 | 24.0 | 24.0 |
| Sodium sulphate | 25.1 | 32.4 |
| Minor ingredients (fluorescer, antiredeposition agent etc) | 3.3 | 3.3 |
| Moisture | 8.0 | 8.0 |
| Total base powder | 70.4 | 80.7 |
| Carrier as in Example 11 | 10.0 | — |
| Nonionic surfactant | 3.0 | — |
| Total adjunct | 13.0 | — |
| Bleach ingredients (sodium perborate, TAED, stabiliser) and minor ingredients (enzyme, lather suppressor, perfume etc) | 11.6 | 11.6 |
| Sodium carbonate | 5.0 | 7.7 |
| TOTAL COMPOSITION | 100.0 | 100.0 |

The properties of the final powders were as follows:

| | 25 | L |
|---|---|---|
| Dynamic flow rate (ml/s) | 110 | 85 |
| Compressibility (% v/v) | 20 | 30 |
| Cohesion test value (kg) | 0.5 | 1.5 |
| Bulk density (g/liter) | 540 | 540 |

Use of the adjunct to carry the nonionic surfactant increased the dynamic flow rate of the powders, and decreased both compressibility and cohesivity.

EXAMPLE 26

This Example illustrates the use of crystal-growth-modified Burkeite as an adjunct carrier for an aqueous solution of an anionic surfactant (sodium linear alkylbenzene sulphonate).

Two carrier materials, Composition 26 in accordance with the invention and Composition M, a control containing no crystal-growth-modified Burkeite, were prepared by slurry-making and spray-drying to the following formulations, the polyacrylate in Composition 26 being introduced into the slurry before the inorganic salts:

| | 26 | M |
|---|---|---|
| Sodium polyacrylate (molecular weight 4000) | 1.5* | — |
| Sodium sulphate | 68.9 | 70.0 |
| Sodium carbonate | 25.7 | 26.1 |
| Nonionic surfactant (Synperonic A7) | 1.5 | 1.5 |
| Moisture | 2.4 | 2.4 |
| | 100.0 | 100.0 |

*1.6% based on sodium sulphate + sodium carbonate.

Ratio sodium carbonate: sodium sulphate =0.37:1.

An aqueous solution of anionic surfactant (2% sodium linear alkylbenzene sulphonate, 98% water) was sprayed onto each of these materials, to give adjuncts containing 90% carrier material and 10% surfactant solution. The properties of the adjuncts were as follows:

| | 26 | M |
|---|---|---|
| Fresh | | |
| Dynamic flow rate (ml/s) | 85 | nil |
| Compressibility (% v/v) | 18 | 48 |
| After 4 months' ambient Storage | | |
| Dynamic flow rate (ml/s) | 90 | nil |
| Compressibility (% v/v) | 12 | 39 |

It will be seen that the control adjunct had completely unacceptable properties.

EXAMPLES 27–29

In the manner described in Example 26, adjuncts containing aqueous solutions of bleaching agents were prepared. The adjunct carrier was Composition 26 described above, and each adjunct was prepared by spraying 10 parts of the aqueous bleach material specified below onto 90 parts of the carrier material.

Bleach materials

Example 27: hydrogen peroxide (30% w/v)
Example 28: peroxyacetic acid (40% w/v)
Example 29: sodium hypochlorite (5% w/v).

All three adjuncts were free-flowing particulate materials.

EXAMPLES 30 and 31

These Examples illustrate the preparation of crystal-growth-modified Burkeite by a method other than spray-drying, namely, oven-drying.

Slurries were prepared to the formulation given below. Compositions 30 and 31 were in accordance with the invention, while Composition N was a control containing no crystal growth modifier; in the preparation of slurries 30 and 31, the polymeric crystal growth modifier was added before the inorganic salts.

| | 30 | 31 | N |
|---|---|---|---|
| Sodium polyacrylate (molecular weight 25 000) | 1.0* | — | — |
| Neutralised polyphosphino-carboxylic acid (Belclene (Trade Mark) 500 ex Ciba-Geigy) | — | 1.0* | — |
| Sodium carbonate | 12.2 | 12.2 | 12.5 |
| Sodium sulphate | 33.3 | 33.3 | 34.0 |
| Water | 53.5 | 53.5 | 53.5 |
| | 100.0 | 100.0 | 100.0 |

*2.2% based on sodium sulphate + sodium carbonate.

Ratio sodium carbonate: sodium sulphate =0.37:1.

The slurries were filtered and the filter cakes dried in an oven at an air temperature of 150° C. The dried cakes were crushed and sieved, and the powders passing a 1400 μm screen were collected.

The compositions of the powders were as follows:

| | 30 | 31 | N |
|---|---|---|---|
| Polymer | 2.1 | 2.1 | — |
| Sodium carbonate | 25.6 | 25.6 | 26.3 |
| Sodium sulphate | 69.9 | 69.9 | 71.4 |
| Moisture | 2.4 | 2.4 | 2.3 |
| | 100.0 | 100.0 | 100.0 |

The capacity of each powder to retain liquid nonionic surfactant was as follows:

| | 30 | 31 | N |
|---|---|---|---|
| Nonionic surfactant retention capacity ($cm^3/kg$) | 360 | 340 | 150 |

The very much greater useful porosity of the crystal-growth-modified materials will be noted.

An "adjunct" was prepared by spraying 23 parts of liquid nonionic surfactant onto 77 parts of Composition 30. The resulting material was a free-flowing powder. When 13 parts of this adjunct were postdosed to 70.4 parts of the base powder of Example 24, together with 11.6 parts of bleaching ingredients and minor ingredients and 5.0 parts of sodium carbonate, a stable, free-flowing detergent powder was obtained.

We claim:

1. A process for the production of a powder suitable for use as a granular detergent composition or a component thereof, which comprises the steps of (i) preparing an aqueous slurry comprising from about 5 to 70% sodium carbonate, and from 0 to about 50% sodium sulphate, (ii) drying the slurry to form a powder, the total amount of sodium carbonate and sodium sulphate being at least 10% by weight based on the dried powder, the weight ratio of sodium carbonate to sodium sulphate in the slurry being at least 0.37:1, the process being characterised in that an effective amount of a crystal growth modifier which is a polymeric polycarboxylate selected from the group consisting of acrylic acid homopolymers, acrylic acid/maleic acid copolymers, acrylic phosphinates and mixtures thereof, is incorporated in the slurry not later than the sodium carbonate, whereby needle-shaped crystal-growth-modified Burkeite is formed in the slurry.

2. A process as claimed in claim 1, characterised in that step (ii) comprises spray-drying the slurry to form a powder.

3. A process as claimed in claim 1, characterised in that the total amount of sodium carbonate and sodium sulphate in the dried powder is at least 15% by weight.

4. A process as claimed in claim 3, characterised in that the total amount of sodium carbonate and sodium sulphate in the dried powder is at least 20% by weight.

5. A process as claimed in claim 1, characterised in that the crystal growth modifier is incorporated as an amount of from 0.1 to 60% by weight based on the total amount of sodium carbonate and sodium sulphate in the dried powder.

6. A process as claimed in claim 5, characterised in that the crystal growth modifier is incorporated in an amount of from 0.1 to 20% by weight, based on the total amount of sodium carbonate and sodium sulphate in the dried powder.

7. A process as claimed in claim 5, characterised in that the crystal growth modifier is incorporated in an amount of from 0.2 to 5% by weight, based on the total amount of sodium carbonate and sodium sulphate in the dried powder.

8. A process as claimed in claim 1, characterised in that the crystal growth modifier is sodium polyacrylate.

9. A process as claimed in claim 1, characterised in that the polymeric polycarboxylate has a molecular weight within the range of from 1,000 to 250,000.

10. A process as claimed in claim 9, characterised in that the polymeric polycarboxylate has a molecular weight within the range of from 3,000 to 100,000.

11. A process as claimed in claim 9, characterised in that the polymeric polycarboxylate has a molecular weight within the range of from 10,000 to 70,000.

12. A process as claimed in claim 1, which comprises the further step of (iii) incorporating a liquid or liquefiable detergent composition in liquid form in the dried powder of step (ii).

13. A process as claimed in claim 12, characterised in that the liquid or liquefiable detergent component is a nonionic surfactant.

14. A process as claimed in claim 12, characterised in that the liquid or liquefiable detergent component is an ethoxylated nonionic surfactant having an average degree of ethoxylation of 10 or less.

15. A process as claimed in claim 12, characterised in that the liquid or liquefiable detergent component is a nonionic surfactant and is incorporated in an amount such that the product of step (iii) comprises from 5 to 40% by weight of nonionic surfactant and from 60 to 95% by weight of the dried powder.

* * * * *